US008604894B2

(12) United States Patent
Lagorsse et al.

(10) Patent No.: US 8,604,894 B2
(45) Date of Patent: Dec. 10, 2013

(54) COMPACT THERMOELASTIC ACTUATOR FOR WAVEGUIDE, WAVEGUIDE WITH PHASE STABILITY AND MULTIPLEXING DEVICE INCLUDING SUCH AN ACTUATOR

(75) Inventors: Joël Lagorsse, Castanet Tolosan (FR); Fabien Montastier, La Salvetat Saint Gilles (FR)

(73) Assignee: Thales, Neuilly sur Seine (FR)

( * ) Notice: Subject to any disclaimer, the term of this patent is extended or adjusted under 35 U.S.C. 154(b) by 434 days.

(21) Appl. No.: 12/969,029

(22) Filed: Dec. 15, 2010

(65) Prior Publication Data

US 2011/0148551 A1 Jun. 23, 2011

(30) Foreign Application Priority Data

Dec. 23, 2009 (FR) ..... 09 06278

(51) Int. Cl.
*H01P 5/12* (2006.01)
*H01P 3/12* (2006.01)
*H01P 1/30* (2006.01)

(52) U.S. Cl.
USPC ..... 333/137; 333/234; 333/248

(58) Field of Classification Search
USPC ..... 333/135, 202, 208, 209, 219, 227–229, 333/234, 239, 241, 248, 137
See application file for complete search history.

(56) References Cited

U.S. PATENT DOCUMENTS

| | | | |
|---|---|---|---|
| 4,057,772 | A | 11/1977 | Basil, Jr. et al. |
| 5,428,323 | A | 6/1995 | Geissler et al. |
| 7,671,708 | B2 | 3/2010 | Lagorsse et al. |

FOREIGN PATENT DOCUMENTS

| | | | | |
|---|---|---|---|---|
| CA | 2 432 876 | A1 | | 12/2003 |
| CA | 2635177 | A1 | * | 12/2008 |
| DE | 43 19 886 | C1 | | 7/1994 |
| DE | 103 49 533 | A1 | | 6/2005 |
| EP | 1 909 355 | A2 | | 4/2008 |
| EP | 2 006 951 | A1 | | 12/2008 |

* cited by examiner

*Primary Examiner* — Benny Lee
*Assistant Examiner* — Rakesh Patel
(74) *Attorney, Agent, or Firm* — Baker & Hostetler LLP

(57) ABSTRACT

A compact thermoelastic actuator includes at least two identical force pieces and a securing piece, the securing piece having a coefficient of thermal expansion less than the coefficient of thermal expansion of the force pieces. The force pieces are mounted head-to-tail one beside the other parallel to a longitudinal axis Y and are linearly offset relative to one another, along the longitudinal axis Y. The securing piece has two ends respectively linked to external ends of each force piece and internal ends of each force piece are positioned under a median region of the securing piece. The actuator and device is applicable to waveguides of multiplexers incorporated in space equipment for satellites.

13 Claims, 8 Drawing Sheets

COMPACT THERMOELASTIC ACTUATOR FOR WAVEGUIDE, WAVEGUIDE WITH PHASE STABILITY AND MULTIPLEXING DEVICE INCLUDING SUCH AN ACTUATOR

CROSS-REFERENCE TO RELATED APPLICATION

This application claims priority to foreign French patent application No. FR 0906278, filed on Dec. 23, 2009, the disclosure of which is incorporated by reference in its entirety.

FIELD OF THE INVENTION

The present invention relates to a compact thermoelastic actuator for a waveguide, a waveguide with phase stability and a multiplexing device including such an actuator. It applies notably to the compensation for the changes of volume of a waveguide subjected to temperature variations and, more particularly, to the waveguides of multiplexers incorporated in space equipment for satellites.

BACKGROUND

The multiplexers or demultiplexers, also called OMUX (output multiplexer) notably incorporated in space equipment are subject to significant temperature variations. These OMUX generally include a number of channels linked together by at least one waveguide, also called manifold, the dimensional variations of which, due to the temperature variations, induce an offset of the geometrical distance between the OMUX channel connection ports and phase shifts in the guided waves. These phase shifts lead to a malfunction of the equipment and can, for example, cause OMUX channel mismatches.

To overcome this problem, it is known to produce the waveguide in a material with low coefficient of thermal expansion CTE, such as titanium or an alloy of iron and nickel such as, for example, Invar (registered trademark). However, since space equipment is generally produced in low density materials such as aluminum which has a high coefficient of thermal expansion, assemblies with waveguides with low CTE cause, during temperature variations, significant mechanical stresses between the structures that might lead to malfunctions.

The document U.S. Pat. No. 5,428,323 describes a method of compensating for the thermal expansion of a rectangular-section waveguide by applying a deformation to its two narrower lateral walls so as to ensure phase stability. The deformation is applied by distancing pieces orthogonal to the small sides and fixed between the small sides of the waveguide and a securing structure with low CTE arranged around the waveguide. In the event of a temperature variation, the distancing pieces are elongated or retracted and pull or press orthogonally on the small sides, which forces the small sides of the waveguide to be deformed along an axis orthogonal to these small sides. However, this technology requires the use of a securing structure arranged around the waveguide.

The document EP 1 909 355 describes another waveguide assembly with phase stability in which lever mechanisms are actuated rotation-wise around pivots under the action of temperature variations and make it possible to compensate for greater dimensional variations of the waveguide according to the temperature by pulling or pressing orthogonally on the small sides of the waveguide. However, this assembly is complex, bulky and may hamper the positioning of the adjacent channels and of the mechanical interfaces of the OMUX in proximity to the waveguide, particularly in the context of a compact herringbone configuration according to which the channels are arranged in a zigzag either side of the waveguide.

The document CA 2 432 876 describes another waveguide assembly with phase stability in which the small sides of the waveguide have an initial curved length and are constrained in a lateral direction of the waveguide by a plurality of plates with low CTE placed side by side along the waveguide laterally on either side of each small curved side. The expansion or contraction of the small sides is restricted by the lateral plates whereas the large sides are free to expand or contract. This assembly has the drawback of requiring the small side of the waveguide to be pre-curved while laterally and symmetrically ribbing the top and bottom parts of the waveguide, thus reducing the margin for positioning the channels relative to the waveguide and the mechanical interfaces of the OMUX in proximity to the waveguide.

SUMMARY OF THE INVENTION

The invention provides a thermoelastic actuator for a waveguide that makes it possible to ensure the phase stability of the waveguide and that does not include the drawbacks of the existing devices. Notably, the invention relates to a thermoelastic actuator for a waveguide that is simple to implement, has a small footprint, is optimized to minimize the volume occupied in proximity to the waveguide and the channels, and particularly suited to a vertical structure OMUX technology.

For this, the invention relates to a compact thermoelastic actuator for a waveguide comprising at least two identical force pieces produced in a first material having a first coefficient of thermal expansion and a securing piece produced in a second material different from the first material and having a second coefficient of thermal expansion less than the first coefficient of thermal expansion, wherein the force pieces have a length that extends along a longitudinal direction Y between two ends, namely an external end and an internal end, are mounted head-to-tail one beside the other parallel to the direction Y and are linearly offset relative to one another, along the longitudinal axis Y, and wherein the securing piece has two ends, namely a top and a bottom end and a median region situated in a central region of the securing piece between the two top and bottom ends, the ends, namely a top and a bottom end, of the securing piece being respectively linked to the external ends of each force piece and the internal ends of each force piece being positioned under the median region of the securing piece.

Advantageously, the linear offset of the force pieces relative to one another, along the longitudinal axis Y, is equal to half their length.

Advantageously, the force pieces are threadlike and may be, for example, longitudinal bars.

Preferably, the force pieces are axially symmetrical. They may, for example, include an internal end in the form of a fork having at least two digits.

In a particular embodiment, the actuator includes at least four force pieces mounted head-to-tail in pairs and the digits of the forks of the consecutive force pieces mounted in the same direction are interleaved one above the other.

Advantageously, each digit includes a fixing point and the fixing points of two interleaved digits belonging to two consecutive force pieces mounted in one and the same direction are linked together.

The invention also relates to a waveguide with phase stability including a rectangular transversal section having two large sides and two opposite small sides and including at least two external longitudinal ribs, respectively top and bottom, situated symmetrically in the extension of the large sides, respectively on the two opposite small sides of the waveguide, the two ribs being offset relative to a median axis of the small sides, the waveguide including at least one compact thermoelastic actuator, the actuator having its longitudinal axis positioned parallel to a large side of the rectangular waveguide and the internal ends of the force pieces of the actuator situated under the median region being respectively fixed to the external longitudinal ribs of the waveguide.

The invention finally relates to a multiplexing device including at least one waveguide with phase stability.

BRIEF DESCRIPTION OF THE DRAWINGS

Other particular features and advantages of the invention will become clearly apparent from the rest of the description given as a purely illustrative and nonlimiting example, with reference to the appended diagrammatic drawings which represent.

DETAILED DESCRIPTION

Figure 1:
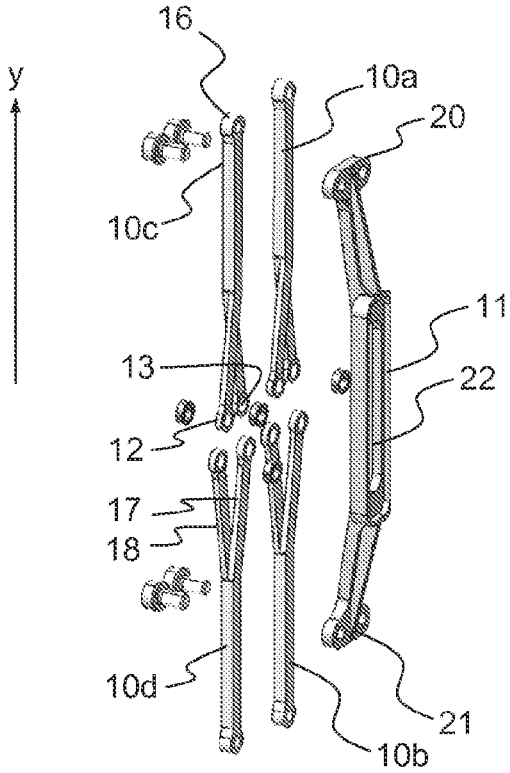
FIGS. 1 and 2: two diagrams, respectively in perspective and in an exploded view, of a first exemplary compact thermoelastic actuator for a waveguide, according to the invention.
Figure 2:
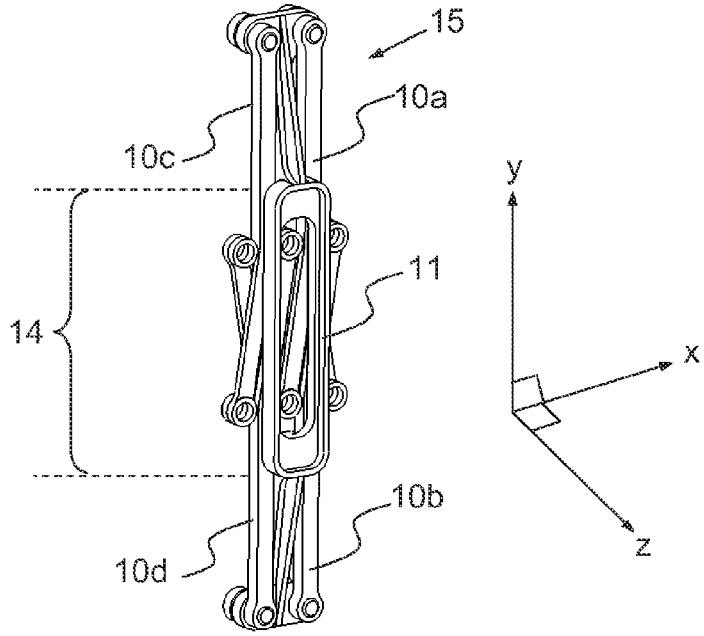
Figure 3A:
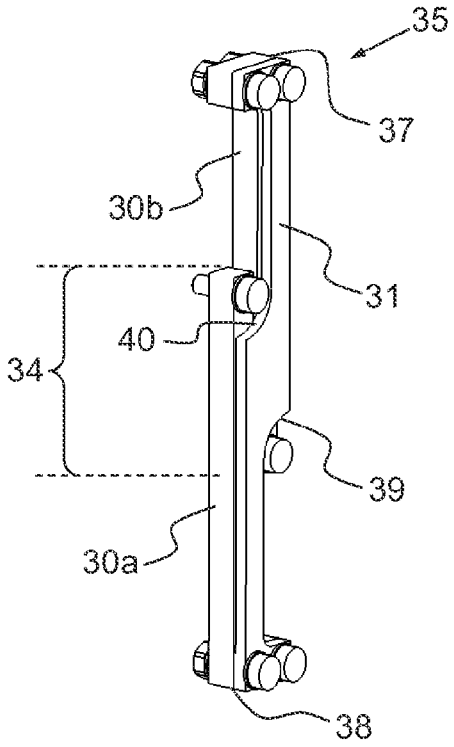
FIGS. 3*a* and 3*b*: two views, in perspective and from below, of a second exemplary compact thermoelastic actuator for a waveguide, according to the invention.
Figure 3B:
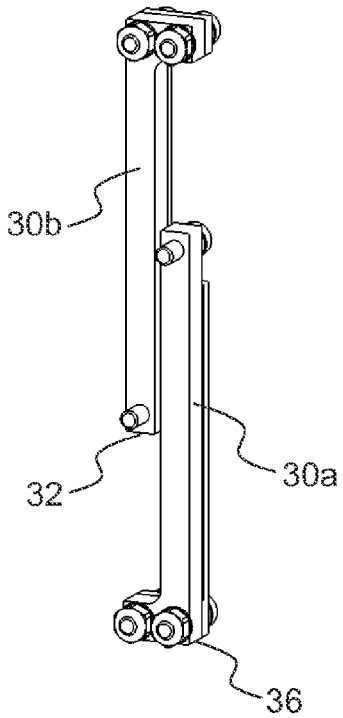

The first exemplary actuator represented in FIGS. 1 and 2 and the second exemplary actuator represented in FIGS. 3*a* and 3*b* are of elongate forms along a longitudinal axis Y and include an even number of identical force pieces 10*a*, 10*b*, 10*c*, 10*d*, 30*a*, 30*b* produced in a first material having a first coefficient of thermal expansion CTE1 and a securing piece 11, 31 produced in a second material, different from the first material and having a second coefficient of thermal expansion CTE2 less than the first coefficient of thermal expansion CTE1. For example, the first material is a heat-conducting material with high coefficient of thermal expansion such as aluminum and the second material is a material with low coefficient of thermal expansion such as titanium or an alloy of iron and nickel such as, for example, Invar. The force pieces 10*a* to 10*d*, 30*a*, 30*b* and the securing piece 11, 31 are of elongate form along a longitudinal axis Y and may have, as in FIGS. 1 and 2, an axial symmetry relative to the longitudinal axis Y. The force pieces are threadlike and may, for example, be substantially straight bars, of small width and small thickness as in FIGS. 3*a* and 3*b*, or have an end in the form of a fork with two digits as in FIGS. 1 and 2, or have any other form with axial symmetry relative to the axis Y, elongated in the direction Y and preferably straight in the directions X and Z orthogonal to the direction Y. The length and the thickness of the force pieces may have values that vary widely depending on the applications. As a nonlimiting example, the force pieces may be a few millimeters thick and a few centimeters long, or values differing by a factor of ten and even more.

The force pieces 10*a*, 10*b* or 10*c*, 10*d* or 30*a*, 30*b* are mounted head-to-tail one beside the other in one and the same plane XY and in such a way that two force pieces mounted facing one another in reverse directions are linearly offset relative to one another, along the longitudinal axis Y, by a distance approximately equal to half their length. Each force piece has an internal end 12, 13, 32 arranged in a median region 14, 34 of the actuator 15, 35 and an external end 16, 36, the internal 12, 13, 32 and external 16, 36 ends being provided with fixing points. In the case of the example, represented in FIGS. 1 and 2, in which the force pieces have internal ends in the form of a fork with two digits 17, 18, the digits 17, 18 of the forks belonging to different consecutive force pieces mounted in the same direction 10*a*, 10*c* or in reverse directions 10*b*, 10*d* are interleaved one above the other in the median region 14 of the actuator 15. In this case, the two innermost interleaved digits belonging to two force pieces mounted in one and the same direction 10*a*, 10*c* are linked together at their fixing point and the same applies for the two force pieces mounted in the reverse direction 10*b*, 10*d*. The securing piece 11, 31 has two opposite ends, respectively top 20, 37 and bottom 21, 38 and a median region situated between the two top and bottom ends, the median region of the securing piece 11, 31 corresponding to the median region 14, 34 of the actuator 15, 35. The securing piece is mounted on a top face of the force pieces so that the median region 14, 34 of the securing piece 11, 31 at least partially covers the internal ends 12, 13, 32 of the force pieces and that its two opposite ends 20, 21, 37, 38 are fixed to the fixing points of the external ends 16, 36 of the force pieces. The securing piece 11, 31 has a small thickness relative to its length, the length and the thickness of the securing piece being of the same order of magnitude as those of the force pieces, and may, for example, have a substantially flat dissymmetrical form which includes a median region 14, 34 with a width equal to or greater than the width of the force pieces provided with lateral voids 39, 40 formed in the thickness of the securing piece, facing the fixing points of the internal ends 12, 13, 32 of the force pieces, as represented in FIGS. 3*a* and 3*b*. Alternatively, and preferably, the securing piece may have a symmetrical form which includes a median region including a central void 22 so as to allow access to fixing points of the actuator situated at the ends of the digits of the force pieces as represented in FIGS. 1 and 2. The securing piece 11, 31 may have any other form, elongate in the longitudinal direction Y, including a median region at least partially covering the internal ends of the force pieces and two opposite ends fixed to the fixing points of the external ends of the force pieces.

Figure 4:
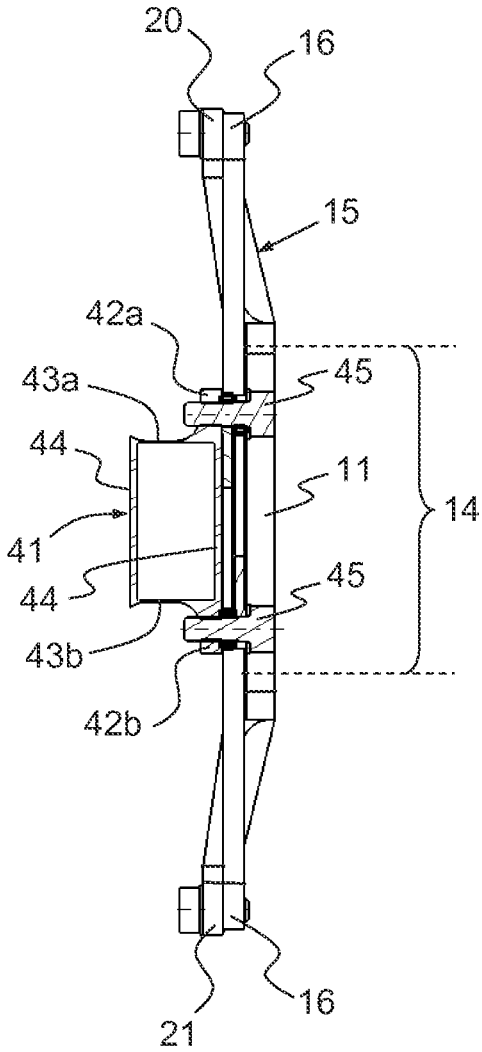
FIG. 4: a transversal cross sectional view of a waveguide with rectangular section at ambient temperature equipped with the compact thermoelastic actuator of FIG. 2, according to the invention.

FIG. 4 represents a transversal cross-sectional view of an assembly of the compact thermoelastic actuator of FIG. 2 on a waveguide 41 with rectangular section at ambient temperature. The rectangular waveguide 41 includes, in transversal cross section, two small sides 43*a*, 43*b* and two large sides 44, opposite and in pairs. The waveguide also includes two external longitudinal ribs 42*a*, 42*b* arranged symmetrically, respectively on each of the small sides 43*a*, 43*b*, in the extension of the large sides 44. The two external ribs 42*a*, 42*b* are parallel to one another, extending over approximately half the width of the small sides 43*a*, 43*b* and are offset relative to the median axis of the small sides. The ribs 42*a*, 42*b* are preferably cut from the blank, and are therefore integral with the waveguide 41. The small sides 43*a*, 43*b* of the waveguide 41 have a wall that is thinner than the large sides 44 so that it is more flexible and can be deformed under the action of traction or compression forces.

The median region 14 of the actuator 15 is fixed to one of the large sides 44 of the rectangular waveguide 41 and simultaneously to the two longitudinal ribs 42*a*, 42*b* respectively situated on the two opposite small sides 43*a*, 43*b* of the waveguide 41. The fixing can be done, for example, by means of fixing screws 45 fitted into tapped holes formed, at the fixing points, in the internal ends 12, 13 of the force pieces 10*a* to 10*d* and passing through one or other of the longitudinal ribs 42*a*, 42*b*. The bottom faces of the internal ends 12, 13 of the force pieces 10*a* to 10*d* are in contact with the large side 44 and with the ribs 42*a*, 42*b* of the waveguide 41; the top faces of the internal ends 12, 13 of the force pieces 10*a* to 10*d* are arranged under the median region of the securing piece 11. Since the geometry of the actuator 15 is axially symmetrical and the force pieces 10*a* to 10*d* are mounted head-to-tail, the digits 17, 18 of the force pieces 10*a* and 10*c* oriented in one and the same direction are linked to one and the same rib 42*b*, the digits 17, 18 of the force pieces 10*b* and 10*d* oriented in an opposite direction are linked symmetrically to the opposite rib 42*a*. In the example of the symmetrical actuator represented in FIGS. 1, 2 and 4, four force pieces 10*a* to 10*d*, each including two digits 17, 18, are mounted head-to-tail in pairs, two of the force pieces 10*a*, 10*c* being oriented in one and the same direction in which the digits are fixed to the bottom rib 42*b* of the waveguide 41, two other force pieces being oriented in one and the same reverse direction in which the digits are fixed to the top rib 42*a* of the waveguide 41. The two innermost interleaved digits belonging to two force pieces mounted in one and the same direction are linked together; the two outermost digits are not interleaved and are fixed only to one rib. The four digits oriented in one and the same direction are therefore respectively linked to one and the same rib at three different fixing points.

Figure 5A:
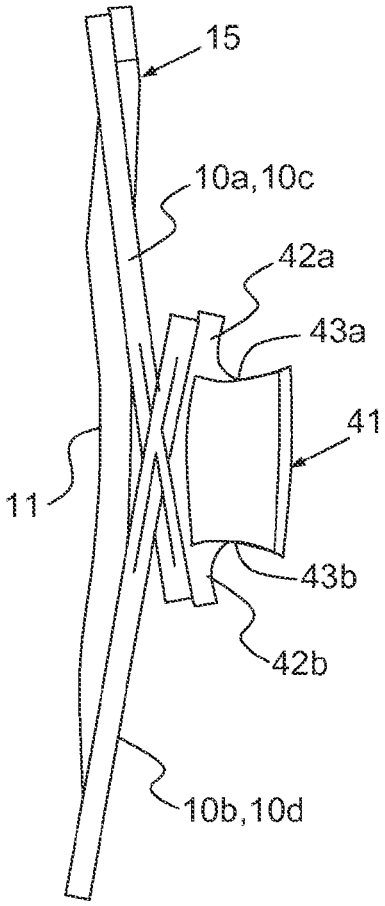
FIGS. 5*a* and 5*b*: two views, respectively in cross section and in perspective, of the waveguide of FIG. 4 when the temperature rises, according to the invention.
Figure 5B:
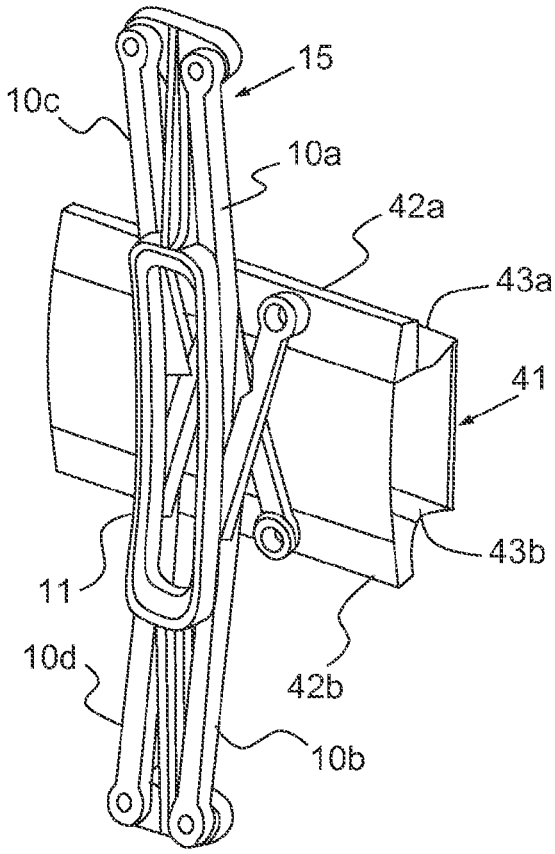

FIGS. 5*a* and 5*b* represent two views, respectively in cross section and in perspective, of the assembly of FIG. 4 when the temperature rises. When the temperature varies, the waveguide and the ribs produced in one and the same material with high CTE, such as, for example, aluminum, expand or contract which is reflected by a phase-shift of the electrical waves being propagated in the waveguide. The force pieces produced in a material with high CTE that is preferably electrically conductive, which may be identical to or different from the material used for the waveguide, are linked to the ribs of the waveguide via link screws and are therefore subject to the same temperature variations as the waveguide. These force pieces will therefore also expand or contract. However, the securing piece produced in a material with low CTE, such as Invar for example, will expand much less than the force pieces, keep a length very close to its initial length and maintain an almost constant distance between the external ends 16 of the force pieces. The significant difference between the coefficients of thermal expansion CTE1 and CTE2 therefore makes it possible to generate a relative motion between the force pieces fixed to the top rib and the force pieces fixed to the bottom rib. The expansions or the contractions of the force pieces will therefore be reflected by crossed displacements of the digits 17, 18 of the forks situated at the internal ends of the force pieces 10*a* to 10*b*. The digits will be moved symmetrically relative to one another, be bent and apply compression or traction forces to the ribs of the waveguide via the link screws. The traction or compression forces on the ribs will be reflected by a rotational movement of the ribs on themselves and lead to a deformation of the small sides of the waveguide. Since the geometry of the actuator 15 is axially symmetrical, the digits 17, 18 being symmetrically interleaved relative to one another and respectively linked at three different fixing points to the two opposite ribs 42*a*, 42*b*, the forces are applied simultaneously and symmetrically to both ribs 42*a*, 42*b*. The displacement of the force pieces is simultaneously proportional to the temperature, to the length of the force pieces between the two external ends in the longitudinal direction, and to the coefficient of expansion of the force pieces. The external ends 16 of the force pieces and the ends 20, 21 of the securing piece are linked only together and not to any other piece. The use of four force pieces makes it possible to better distribute the forces on the ribs and improve the transmission of the compression or traction movement, but it is also possible to use only two bulkier force pieces, as represented in FIGS. 3*a* and 3*b*, or an even number of force pieces greater than four. Alternatively, it is also possible to use an odd number of force pieces.

Figure 6A:
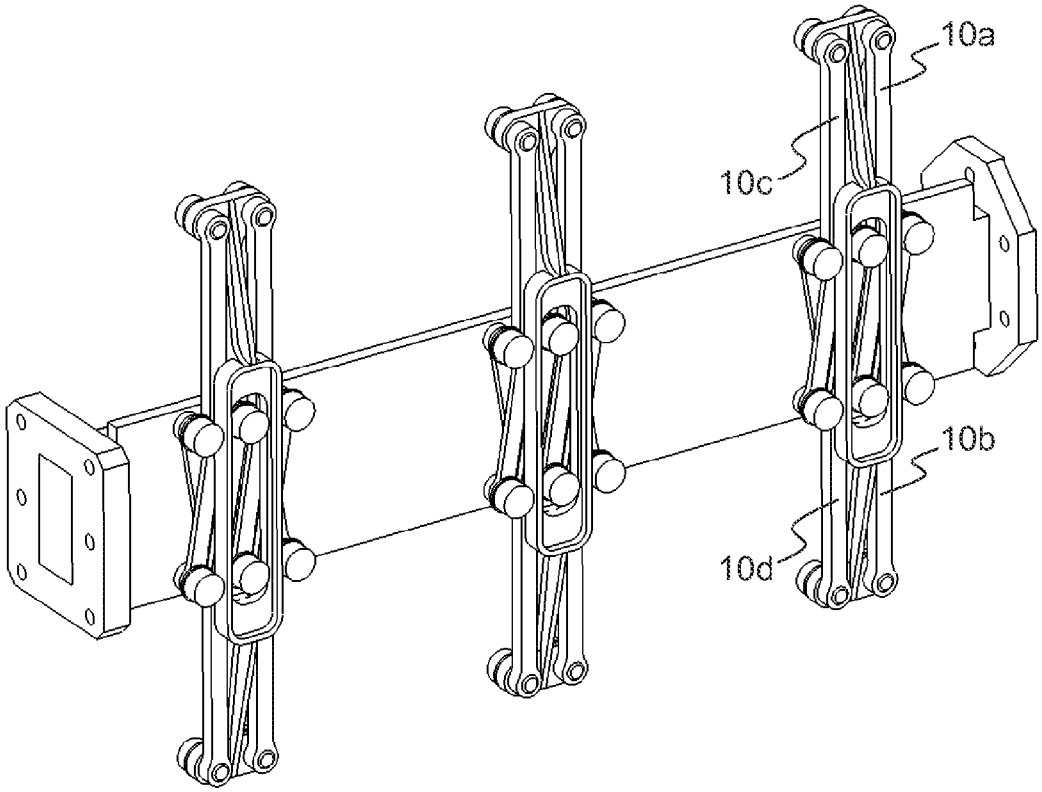
FIGS. 6*a*, 6*b*, 6*c*: perspective views of a rectangular waveguide equipped with several compact thermoelastic actuators, 6*a*, 6*b*: the actuators are all distributed against one and the same side of the guide—6*c*: the waveguide includes several zigzag ribs and the actuators are positioned in a zigzag fashion against two sides of the waveguide, according to the invention.
Figure 6B:
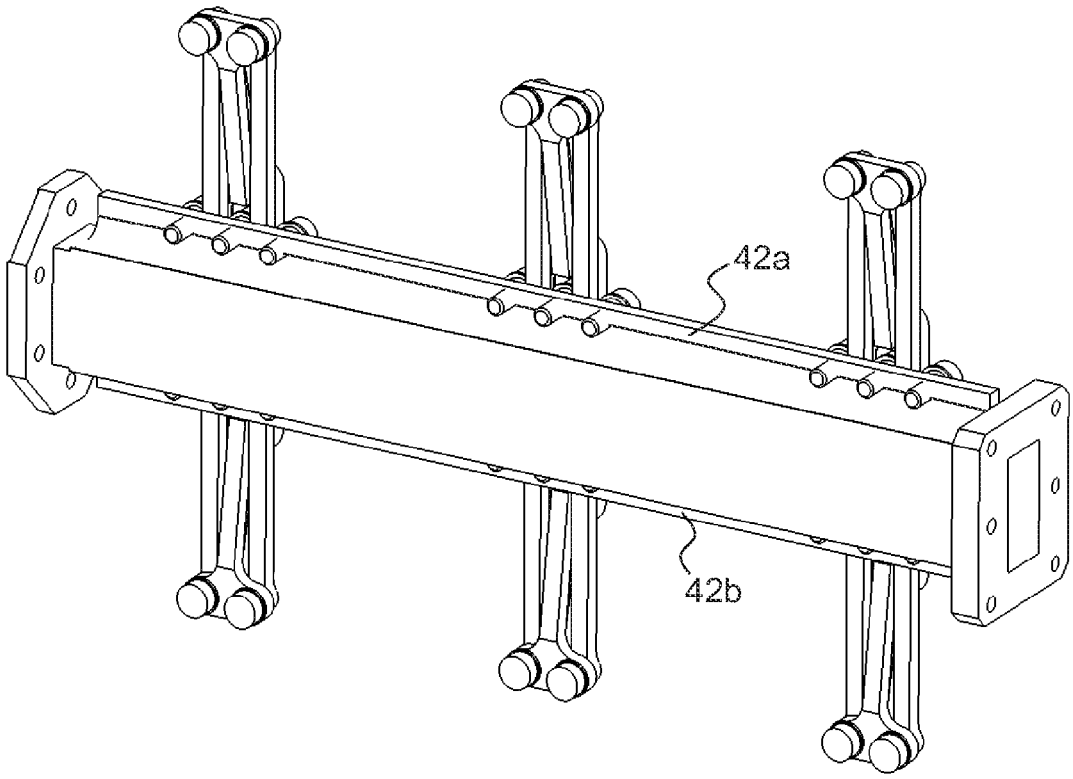
Figure 6C:
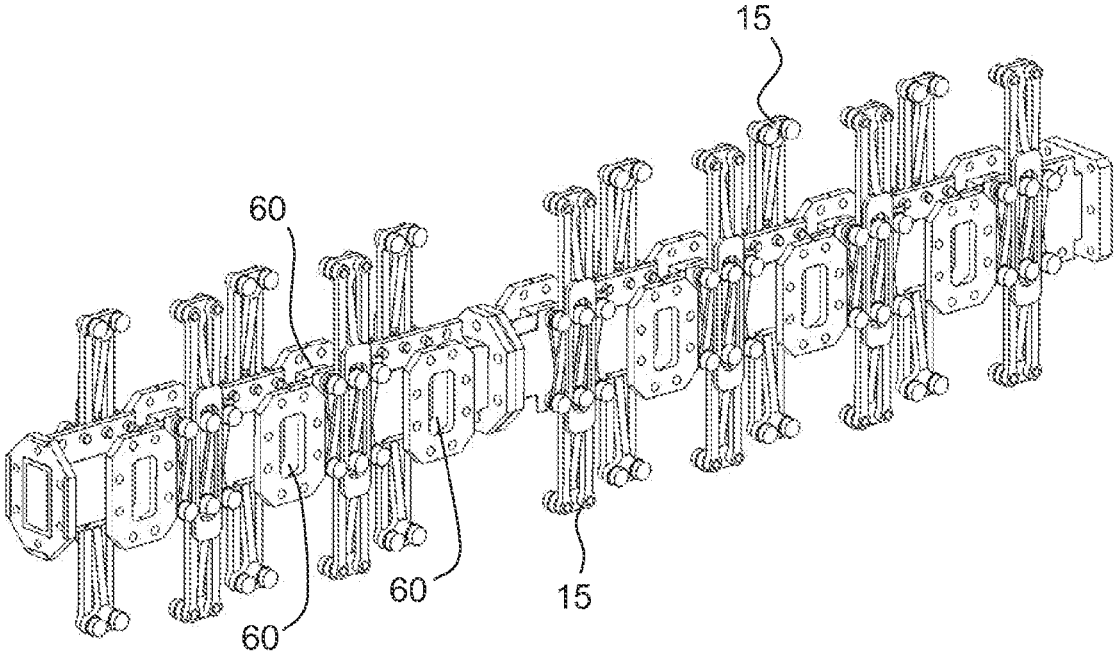

FIGS. 6*a*, 6*b* and 6*c* represent perspective views of a rectangular waveguide equipped with several compact thermoelastic actuators according to the invention.

In FIGS. 6*a* and 6*b*, the waveguide includes two external longitudinal ribs, namely a top one 42*a* and bottom one 42*b*, respectively fixed, or cut from the blank, to its top and bottom walls corresponding, in transversal cross section, to the two opposite small sides 43*a*, 43*b* of the rectangular section of the waveguide. The two top and bottom ribs are offset relative to the median axis of the top and bottom walls and extend symmetrically in the extension of a side of the waveguide corresponding, in transversal cross section, to a large side 44 of the rectangular section. The actuators are distributed at regular intervals along the rectangular waveguide, against one and the same side, and include force pieces 10*a* to 10*d* that are fixed, by their median region, parallel to a side of the waveguide to the two top and bottom ribs. In FIG. 6*c*, the waveguide includes several top and bottom ribs arranged in a zigzag and input ports 60 on its two sides and the actuators 15 are arranged in a zigzag on the two sides of the waveguide either side of each of the input ports 60.

Figure 7:
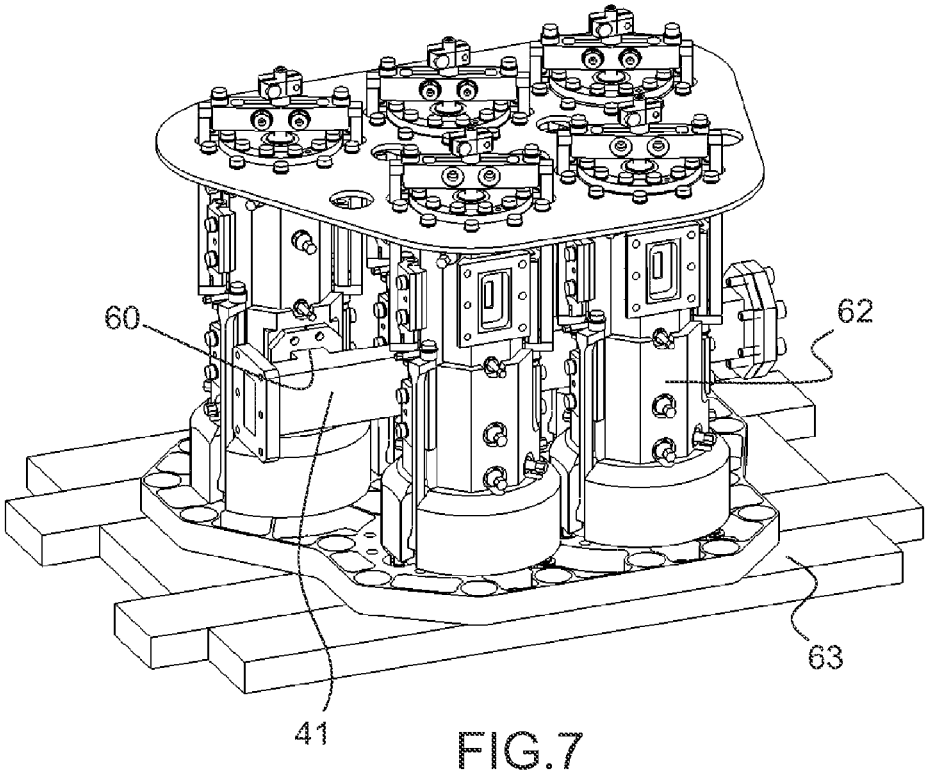
FIGS. 7 and 8: two views, respectively in perspective and in transversal cross section, of two exemplary multiplexers with channels of vertical topology, according to the invention.
Figure 8:
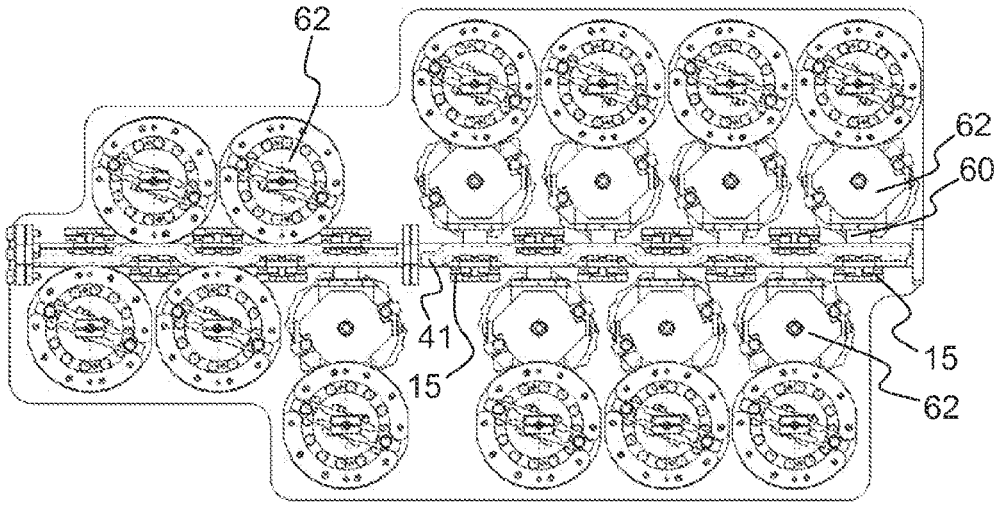

FIGS. 7 and 8 respectively represent, in perspective and in transversal cross section, two exemplary multiplexers, also called OMUX, including microwave filters 62, each having an output linked to a port 60 of a common rectangular waveguide 41. The ports 60 of the rectangular waveguide are formed at regular intervals on its two largest sides corresponding to the large sides 44 of the rectangular section. The filters 62 are arranged parallel to one another and are fixed vertically to a common support 63. The waveguide is arranged horizontally between two rows of filters linked to the ports on its two sides. The thermoelastic actuators 15 can be seen in the transversal cross section of FIG. 8. This figure shows that, when the microwave filters 62 are arranged vertically, the space available between the filters for the thermoelastic actuators 15 is very restricted. The actuator of the invention extends essentially in a longitudinal direction Y and is very compact in the other directions, which makes it possible to insert it easily between two consecutive filters, its longitudinal axis Y being placed parallel to the vertical axis of the channels of the filters.

Although the invention has been described in relation to particular embodiments, it is very obvious that it is in no way limited and that it includes all the technical equivalents of the means described and their combinations if they fall within the context of the invention.

The invention claimed is:

1. A compact thermoelastic actuator for a waveguide, comprising:

at least two identical force pieces produced in a first material having a first coefficient of thermal expansion; and a securing piece produced in a second material different from the first material and having a second coefficient of thermal expansion less than the first coefficient of thermal expansion, wherein the at least two identical force pieces have a length that extends along a longitudinal axis between two ends, namely an external end and an internal end, wherein the at least two identical force pieces are mounted head-to-tail one beside the other parallel to the longitudinal axis and are linearly offset relative to one another, along the longitudinal axis, and wherein the securing piece has two ends, namely a top end and a bottom end, and a median region situated between the top end and the bottom end of the securing piece, the top end and the bottom end of the securing piece being respectively linked to the external end of each of the at least two identical force pieces and the internal end of each of the at least two identical force pieces being positioned under the median region of the securing piece.

2. The actuator as claimed in claim 1, wherein the linear offset of the at least two identical force pieces relative to one another, along the longitudinal axis, is equal to half a length of each of the at least two identical force pieces.

3. The actuator as claimed in claim 1, wherein the at least two identical force pieces are threadlike.

4. The actuator as claimed in claim 1, wherein the at least two identical force pieces are longitudinal bars.

5. The actuator as claimed in claim 1, wherein the at least two identical force pieces are axially symmetrical.

6. The actuator as claimed in claim 5, wherein the internal end of each of the at least two identical force pieces has a form of a fork having at least two digits.

7. The actuator as claimed in claim 6, wherein the at least two identical force pieces includes at least four force pieces mounted head-to-tail in pairs, and wherein the digits of the forks of consecutive force pieces mounted in the same direction are interleaved one above the other.

8. The actuator as claimed in claim 7, wherein each digit includes a fixing point, and wherein the fixing points of two interleaved digits belonging to the consecutive force pieces mounted in the same direction are linked together.

9. A waveguide with phase stability, comprising;

a rectangular transversal section having two large sides and two opposite small sides, and including at least one top external longitudinal rib and at least one bottom external longitudinal rib, situated symmetrically in an extension of the two large sides, respectively on the two opposite small sides of the waveguide, said waveguide including at least one compact thermoelastic actuator as claimed in claim 1, a longitudinal axis of the at least one compact thermoetastic actuator is positioned parallel to a large side of the waveguide and the internal ends of the at least two identical force pieces of the actuator situated under the median region being respectively fixed to the at least one top external longitudinal rib and the at least one bottom external longitudinal rib of the waveguide.

10. The waveguide with phase stability as claimed in claim 9, wherein the at least one compact thermoelastic actuator includes several compact thermoelastic actuators placed against one of the two large side of the waveguide.

11. The waveguide with phase stability as claimed in claim 9, wherein the at least one compact thermoelastic actuator includes several compact thermoelastic actuators, and wherein the at least one top external longitudinal rib and the at least one bottom external longitudinal rib are arranged symmetrically in zigzag fashion on the two opposite small sides of the waveguide, the several compact thermoelastic actuators being placed in a zigzag manner against each of the two large sides of the waveguide.

12. The waveguide with phase stability as claimed in claim 9, wherein the at least two identical force pieces of the at least one compact thermoelastic actuator are mounted head-to-tail, internal ends of each of the at least two identical force pieces having a form of a fork including at least two digits, wherein the at least two identical force pieces includes one force piece, and wherein the at least two digits of the fork of the one force piece are fixed to the at least one top external longitudinal rib and the at least one bottom external longitudinal rib.

13. A multiplexing device, including at least one waveguide with phase stability as claimed in claim 9.

* * * * *